US008827177B2

(12) United States Patent
Michelsen

(10) Patent No.: US 8,827,177 B2
(45) Date of Patent: Sep. 9, 2014

(54) SPRINKLER

(76) Inventor: Jeff A. Michelsen, Glendora, CA (US)

( * ) Notice: Subject to any disclaimer, the term of this patent is extended or adjusted under 35 U.S.C. 154(b) by 333 days.

(21) Appl. No.: 13/338,609

(22) Filed: Dec. 28, 2011

(65) Prior Publication Data

US 2012/0175426 A1 Jul. 12, 2012

Related U.S. Application Data

(60) Provisional application No. 61/431,584, filed on Jan. 11, 2011.

(51) Int. Cl.

| | |
|---|---|
| ***B05B 17/08*** | (2006.01) |
| ***B05B 3/06*** | (2006.01) |
| ***B05B 3/08*** | (2006.01) |
| ***B05B 3/02*** | (2006.01) |

(52) U.S. Cl.

USPC ..... 239/12; 239/7; 239/17; 239/229; 239/231; 239/251; 239/256; 239/258; 239/DIG. 1

(58) Field of Classification Search

USPC ..... 239/1, 7, 11, 12, 16–19, 103, 211, 239/225.1, 229, 231, 246, 251, 252, 253, 239/256–258, 261, 289, 536, DIG. 1

See application file for complete search history.

(56) References Cited

U.S. PATENT DOCUMENTS

| | | | | |
|---|---|---|---|---|
| 1,571,950 | A * | 2/1926 | Humphrey | 239/247 |
| 1,862,381 | A | 6/1932 | Moon | |
| 5,704,549 | A * | 1/1998 | Kephart et al. | 239/236 |
| 6,050,501 | A * | 4/2000 | O'Rourke | 239/229 |
| 2007/0246568 | A1 * | 10/2007 | Baird | 239/214.13 |
| 2009/0266908 | A1 | 10/2009 | Michelsen | |

OTHER PUBLICATIONS

Amazon.com: Shower Flower Sprinkler: Toys & Games; website: http://www.amazon.com/Prime-Time-Toys-Shower-Sprinkler/dp/B001; printed off website Dec. 8, 2010; 5 pages.

Banzai Wigglin' Waterpillar Sprinkler—Manley—Toys "R" Us; website: http://www.toysrus.com/product/index.jsp-?productId=2549830; printed off website Dec. 8, 2010; 5 pages.

Sizzlin' Cool Splash Balls Sprinkler—Toys R US —Toys "R" Us; website—http:///www.toysrus.com/product/index.jsp-?productId=2305149; printed off website Dec. 8, 2010; 5 pages.

* cited by examiner

*Primary Examiner* — Darren W Gorman

(74) *Attorney, Agent, or Firm* — Wilson Daniel Swayze, Jr.

(57) ABSTRACT

According to one aspect, embodiments of the invention provide a sprinkler comprising a base, a connector coupled to the base and configured for coupling to an external water supply, and a body rotatably mounted on the base and in fluid communication with the water supply through the connector and the base, the body including one or more orifices configured to spray, in a defined pattern, water received from the external water supply, and further including at least one hole configured to spray, in a substantially horizontal direction, water received from the external water supply, wherein the spray exiting from the at least one hole causes the body to rotate, and wherein the defined pattern of the spray exiting the one or more orifices is a spiral or helical-shaped spray.

15 Claims, 8 Drawing Sheets

SPRINKLER

RELATED APPLICATION

This application claims priority under 35 U.S.C. §119(e) to U.S. Provisional Application No. 61/431,584, entitled "SPRINKLER," filed Jan. 11, 2011, which is hereby incorporated by reference in its entirety for all purposes.

BACKGROUND OF THE DISCLOSURE

1. Field of the Invention

At least one example in accordance with the present invention relates generally to aquatic sprinklers.

2. Discussion of Related Art

Sprinklers are constructed in a variety of common configurations. For example, typical stationary sprinklers may include a base with multiple spray openings that spray water in a desired pattern, oscillating sprinklers may include a spray tube with multiple spray openings that spray water in a rectangular pattern, and rotary sprinklers may include watering arms that include openings that spray water as they rotate.

Sprinklers may be used not only for landscaping purposes, but oftentimes as amusement devices for children. For example, youngsters may enjoy running through water spraying out of a sprinkler. In addition, sprinklers that include some type of ornamentation may have a visual appeal to children.

SUMMARY

Aspects in accord with the present invention are directed to a sprinkler comprising a base, a connector coupled to the base and configured for coupling to an external water supply, and a body rotatably mounted on the base and in fluid communication with the water supply through the connector and the base, the body including one or more orifices configured to spray, in a defined pattern, water received from the external water supply, and further including at least one hole configured to spray, in a horizontal direction, water received from the external water supply, wherein the spray exiting from the at least one hole causes said body to rotate, and wherein the defined pattern of spray exiting from the one or more orifices is a spiral or helical-shaped spray.

According to one embodiment, the sprinkler further comprises a cone-shaped member extending upwardly from the body and adapted to encompass at least a portion of the defined pattern.

According to another embodiment, the sprinkler further comprises at least one water tube fluidly coupled via the body and the connector to the water supply, wherein the at least one water tube is configured to stand upright when filled with water from the water supply. In one embodiment, the at least one water tube includes an ornamental object coupled to an end thereof. In another embodiment, the at least one water tube is further configured to elevate the ornamental object when water fills the at least one water tube.

According to one embodiment, the ornamental object includes at least one orifice configured to spray water received from the water supply. In one embodiment, each one of the plurality of orifices has a different diameter.

According to another embodiment, the cone-shaped member includes one or more openings between the ends of the member to allow water sprayed from the orifices to exit the cone-shaped member. In another embodiment, the outer surface of the cone-shaped member is covered in a reflective material.

According to one embodiment, the direction at which the spray exits from the at least one hole is adjustable. In another embodiment, the body further includes a post member extending upwardly from the body, the post member having a bottom portion coupled to the body and a top portion including one or more orifices. According to another embodiment the orifices may differ in size and may be selectively located to create a desired spray pattern.

Another aspect in accord with the present invention is directed to a method for providing a helical-shaped spray from a sprinkler, the method comprising providing a base, providing a hose connector coupled to the base and configured for fluid connection to an external water supply, providing a body rotatably mounted on the base and in fluid communication with the external water supply via the hose connector and the base, the body including a plurality of orifices configured to spray, in a defined pattern, water received from the external water supply, and further including at least one hole configured to spray, in a substantially horizontal direction, water received from the external water supply, coupling the hose connector to the external water supply, providing a flow of water to the body from the external water supply via the hose connector so that the spray exiting from the at least one hole causes said body to rotate, and so that the defined pattern of spray exiting from the one or more orifices is a spiral or helical-shaped spray.

According to one embodiment, the method further comprises providing a cone-shaped member extending upwardly from the body and encompassing at least a portion of the defined pattern within the cone-shaped member.

According to another embodiment, the method further comprises providing at least one water tube attached to the body and fluidly coupled to the external water supply via the body and the hose connector, and causing the at least one water tube to stand upright by filling the at least one water tube with water from the water supply. In one embodiment, the method further comprises providing an ornamental object coupled to an end of the at least one water tube. In another embodiment, the method further comprises elevating the ornamental object by filling the at least one water tube with water from the water supply.

According to one embodiment, the method further comprises providing an orifice within the ornamental object, and spraying, from the orifice, water received from the at least one water tube. In one embodiment, the method further comprises adjusting the rotational speed of the body. According to one embodiment, adjusting includes adjusting the direction at which the spray exits from the at least one hole.

One aspect in accord with the present invention is directed to a sprinkler comprising a base, a hose connector coupled to the base and configured for coupling to an external water supply, a body rotatably mounted on the base and in fluid communication with the hose connector through the base, and means for generating a helical-shaped spray of water from the body.

BRIEF DESCRIPTION OF DRAWINGS

The accompanying drawings are not intended to be drawn to scale. In the drawings, each identical or nearly identical component that is illustrated in various FIGs. is represented by a like numeral. For purposes of clarity, not every component may be labeled in every drawing. In the drawings.

DETAILED DESCRIPTION OF THE PREFERRED EMBODIMENTS

Figure 1:
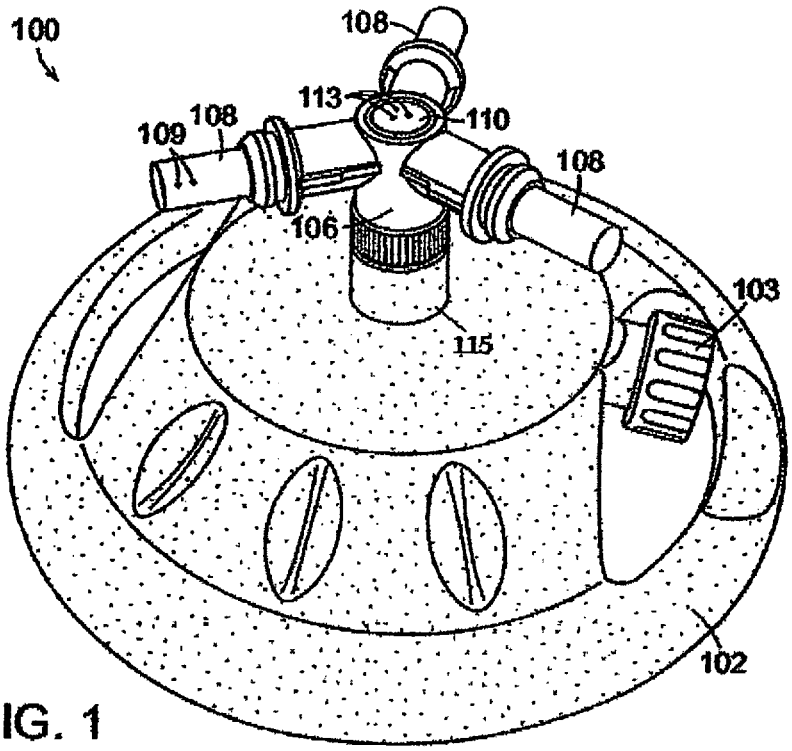
FIG. 1 is an image of a sprinkler in accordance with aspects of the present invention.

For the purposes of illustration only, and not to limit the generality, the present disclosure will now be described in detail with reference to the accompanying figures. This disclosure is not limited in its application to the details of construction and the arrangement of components set forth in the following description or illustrated in the drawings. The disclosure is capable of other embodiments and of being practiced or being carried out in various ways. Also the phraseology and terminology used herein is for the purpose of description and should not be regarded as limiting. The use of "including," "comprising," "having," "containing," "involving," and variations thereof herein, is meant to encompass the items listed thereafter and equivalents thereof as well as additional items.

As described above, aquatic sprinklers often serve as amusement devices for children. As described herein, a sprinkler having ornamentation that may be visually appealing to children is provided.

Figure 1A:
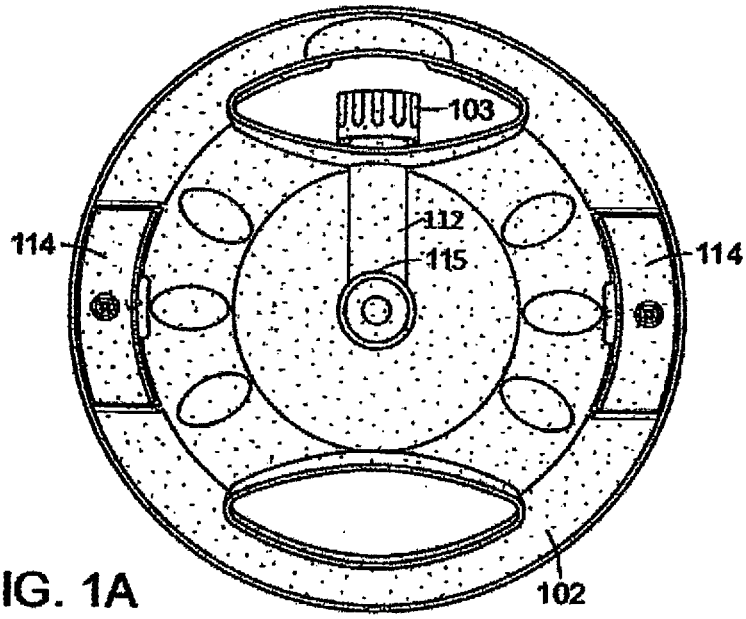
FIG. 1A is a bottom view image of a sprinkler in accordance with aspects of the present invention.
Figure 1B:
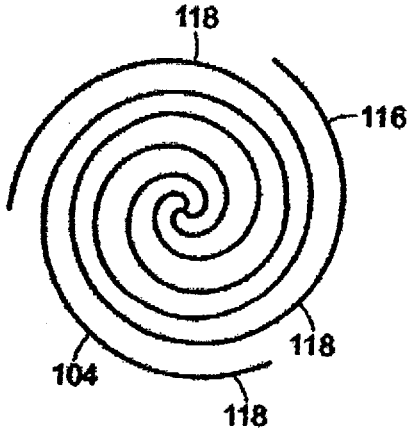
FIGS. 1B-1E illustrate a spiral or helical-shaped spray of water generated in accordance with aspects of the present invention.
Figure 1C:
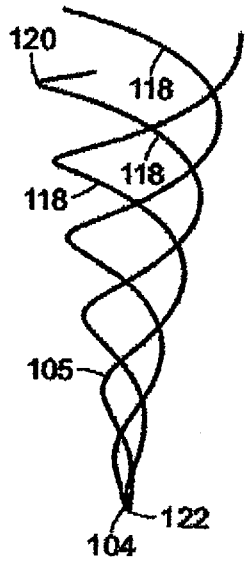
Figure 1D:
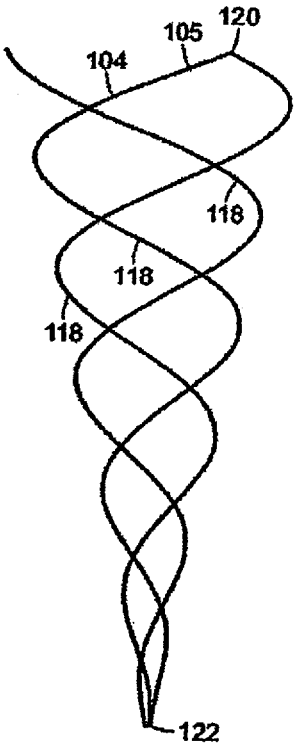
Figure 1E:
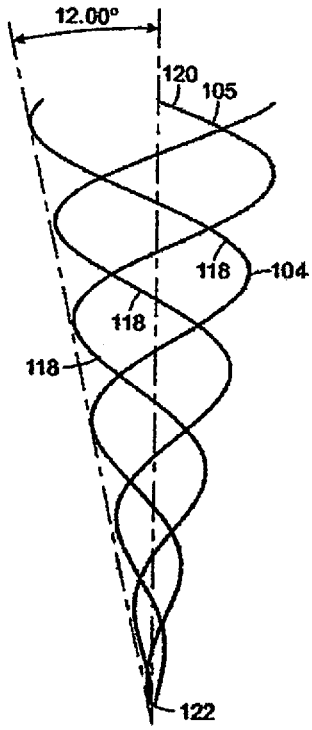

FIG. 1 depicts a sprinkler 100 in accordance with aspects of the present invention. The sprinkler 100 includes a stationary base 102 coupled to a rotatable member 106 through a center post member 115. Hose connector 103 extends from base 102. As seen in the bottom view illustrated in FIG. 1A, according to one embodiment, the stationary base 102 includes an interior chamber 112 fluidly coupled to the hose connector 103 and to the rotatable member 106 through the center post member 115. According to one embodiment, the stationary base 102 also includes at least one weighted foot 114. For example, according to one embodiment, the stationary base 102 may be the base of ACE Hardware's "3-Arm Whirl Sprinkler" having Part No: 7139330.

According to one embodiment, a plurality of spray arms 108 fluidly communicating with chamber 112, extend from rotatable member 106. According to one embodiment, the sprinkler 100 includes three spray arms 108; however, it is to be appreciated that the sprinkler 100 may be configured with any practical number of spray arms 108. Each spray arm 108 includes at least one hole or orifice 109 configured to spray water received through hose connector 103 via the interior chamber 112 and post member 115.

One or more orifices 113 may be located in a top surface 110 of the rotatable member 106, in fluid communication with an external water supply via post member 115, chamber 112, and hose connector 103. According to one embodiment, a plurality of orifices 113 includes orifices of different sizes. For example, in one embodiment, the plurality of orifices are three in number, each equally spaced apart, but having a different diameter. However, it is to be appreciated that top surface 110 of rotatable member 106 may include any number of orifices 113 configured in any desirable way, and of any desired size, as practical. It also is to be appreciated that the orifices may be located anywhere on the rotatable member 106. By varying the size and placement of the orifices, various spray patters may be created.

Hose connector 103 is configured to be coupled to a hose (not shown), for example an ordinary garden hose, for supplying water to the sprinkler 100 in conventional fashion. Water travels through hose connector 103 to the interior chamber 112, into post member 115, and then to the spray arms 108 of the rotatable member 106; spray arms 108 fill with water, pressure builds within the spray arms 108, and water is sprayed out of the at least one hole 109 in each spray arm 108.

According to one embodiment, each one of the holes 109 is configured so that water exiting the holes 109 causes the rotatable member 106 to rotate. For example, in one embodiment, each one of the holes is somewhat angled in a horizontal direction so that water streams exiting the holes force the rotatable member 106, and hence the cone member 204 (as described below), to spin. In one embodiment, the direction in which each hole 109 points is adjustable. It is to be appreciated that by adjusting the direction of spray of each hole 109, a user may also be able to modify the rotational speed of the rotatable member 106 and thereby affect the shape of a spray pattern produced by the sprinkler 100, as discussed below.

Streams of water are also sprayed out of the orifice or orifices 113 located in the top surface 110 of the rotatable member 106. As the rotatable member spins, the streams of water exiting the rotatable member 106 via orifices 113 create a rotating spray pattern, as further described below.

According to one embodiment, the spinning rotatable member 106 and the rotating spray pattern exiting from the orifice or orifices 113 combine to create a visual effect that appears to a user as a spiral or helical-shaped spray of water exiting from the sprinkler 100. For example, FIGS. 1B-1E illustrate a spiral or helical-shaped spray of water 104 created by the sprinkler 100 according to one embodiment. FIGS. 1B-1E illustrate three side views 105 of the spray pattern 104 and a top view 116 of the spray pattern 104. According to one embodiment, as the rotatable member 106 spins, a stream of water 118 is sprayed out of each one of the plurality of orifices 113. As discussed above, according to one embodiment, a plurality of orifices includes multi-sized orifices. In such an embodiment, due to the varying sizes of the orifices 113, each one of the different streams of water 118 from the plurality of orifices 113 sprays in a slightly different direction, causing the streams 118 to be staggered. According to one embodiment, a top portion 120 of the spray of water 104 has a larger diameter than a bottom portion 122. According to another embodiment, each one of the plurality of orifices 113 may be angled differently to allow each orifice to spray water in a slightly different direction, also causing the streams 118 to be staggered. It is to be appreciated that in other embodiments, the plurality of orifices 113 may be configured differently to spray in a different defined spray pattern.

Figure 2:
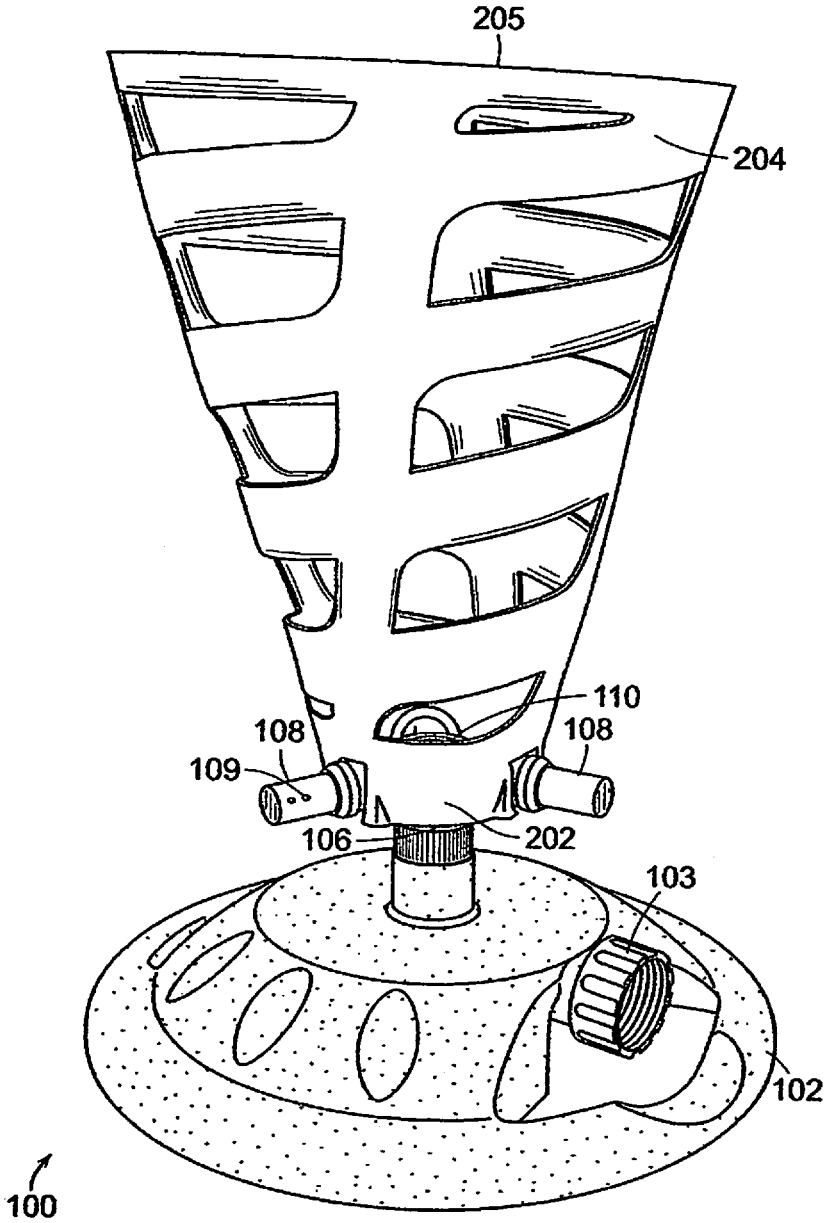
FIG. 2 is an image of a sprinkler including a cone member in accordance with aspects of the present invention.
Figure 2A:
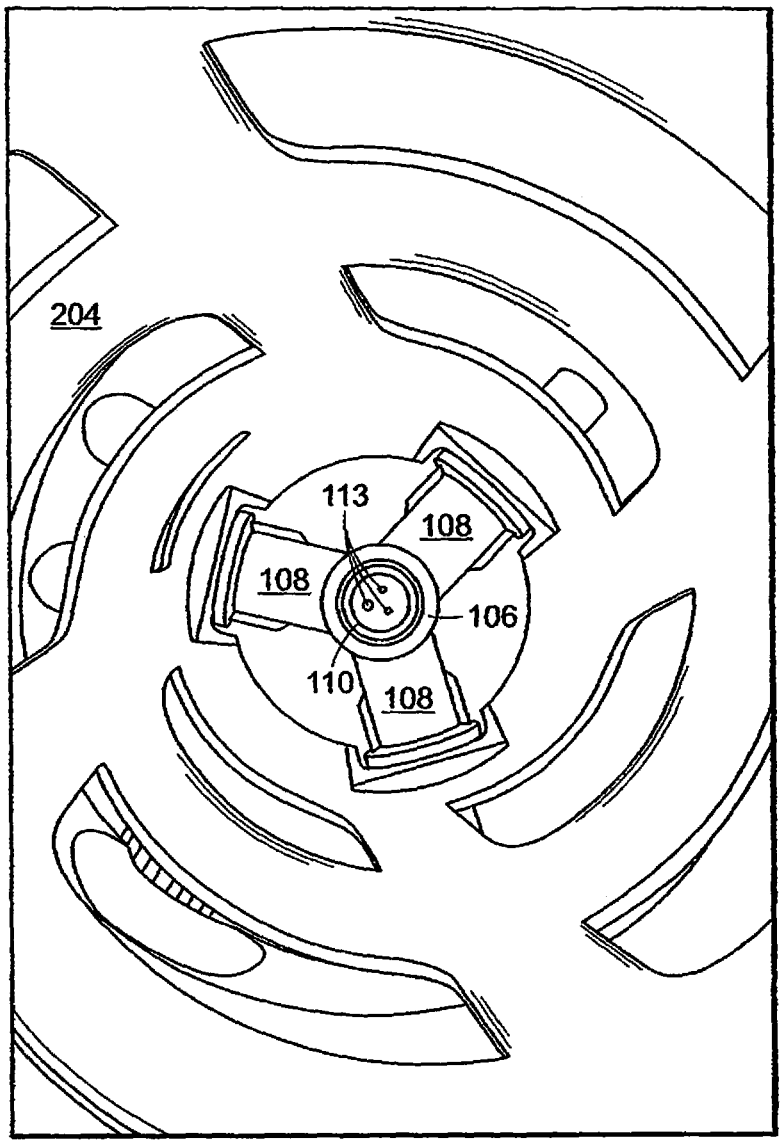
FIG. 2A is a partial top view of a sprinkler including a cone member in accordance with aspects of the present invention.

According to one embodiment, the sprinkler 100 may include additional elements. For example, as shown in FIGS. 2 and 2A, a cone member 204 may be affixed to the sprinkler 100. According to one embodiment, the cone member 204 may be affixed to the rotatable member 106 so that as the rotatable member 106 spins, the cone member 204 also spins.

In one embodiment, the cone member 204 encompasses at least a portion of the rotating spray pattern generated from orifice or orifices 113 (as described above). For example, according to one embodiment, the cone member 204 encompasses the water streams 118 sprayed from the plurality of orifice or orifices 113, with the water streams 118 ultimately exiting through the top 205 of the cone member 204. According to one embodiment, the spinning cone member 204 and the rotating spray pattern exiting from the top 205 of the cone member 204 combine to create a visual effect that appears to a user as a spiral or helical-shaped spray of water exiting from the cone member 204.

According to one embodiment as discussed above, a user may be able to modify the rotational speed of the rotatable member 106 (and hence of the cone member 204) by adjusting the direction of the spray from each hole 109. In such an embodiment, a user may also be able to modify the spiral or helical-shaped spray of water exiting the cone member 204 by adjusting the direction of the spray from each hole 109 (and hence modifying the rotational speed of the rotatable member 106).

Figure 2B:
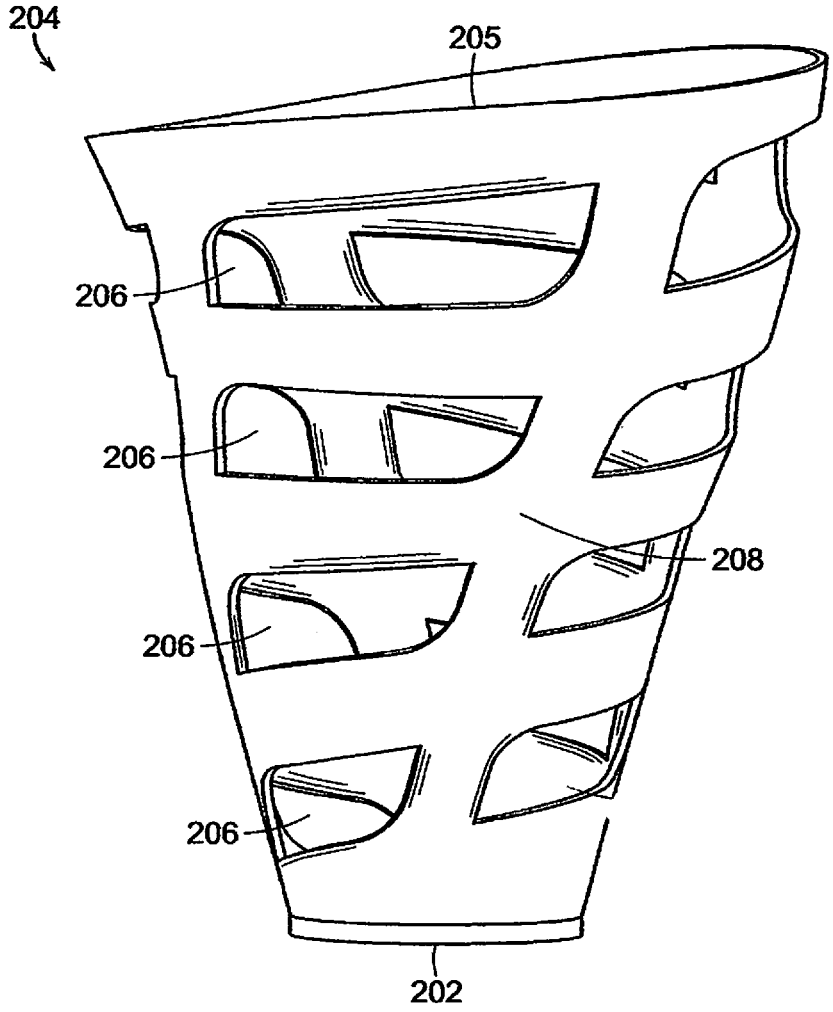
FIG. 2B is an image of a cone member in accordance with aspects of the present invention.

FIG. 2A is a partial view of cone member 204 and FIG. 2B is an image of the cone member 204 in accordance with aspects of the present invention. The cone member 204 is configured in the shape of an inverted frustum of a cone, with the upper end 205 of the cone member 204 having a larger diameter than the bottom end 202. According to one embodiment, the cone member 204 may include a plurality of openings 206 on the outer surface 208 of the cone member 204, reducing the mass of the cone member and decreasing the cost of manufacture. As the rotatable member 106 and cone member 204 spin, the openings 206 in cone member 204 may intersect with the water spraying from orifices 113 to create a visual effect by which it appears to a user that the cone member 204 and the spraying water constitute a spinning spiral or tornado cloud extending upwardly from the base 102. It is to be appreciated that in other embodiments, the plurality of orifices 113 may be configured differently to spray in a different defined spray pattern.

Figure 3A:
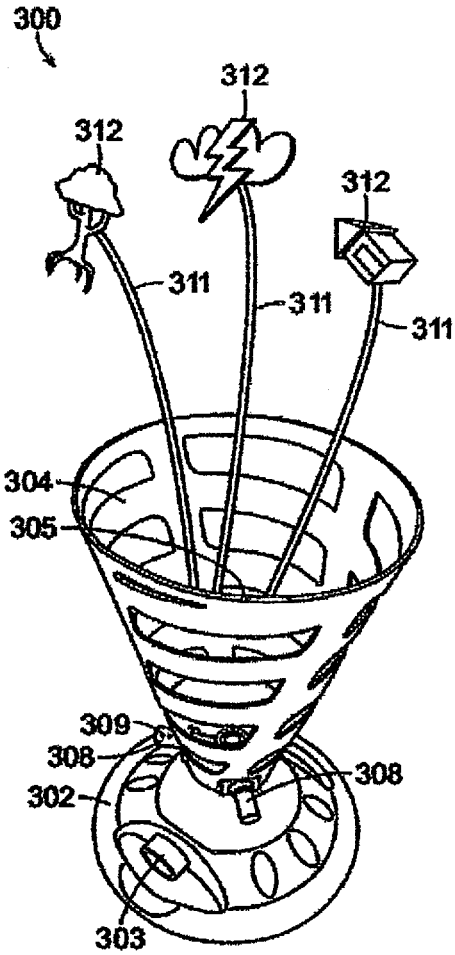
FIGS. 3A-3B illustrate a sprinkler having a plurality of water tubes extending therefrom, and having ornamental elements attached thereto, in accordance with aspects of the present invention.
Figure 3B:
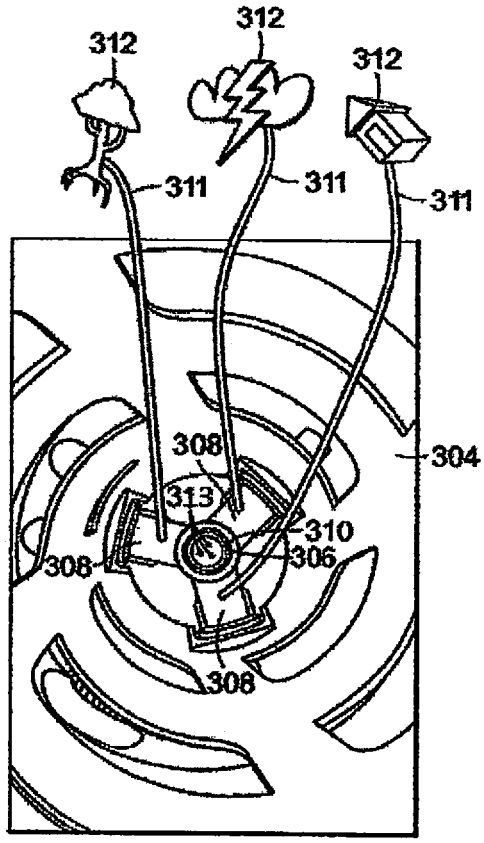

In addition to the cone member 104, the sprinkler 100 may include additional ornamental elements that enhance the spinning spiral or tornado cloud visual effect. For example, FIGS. 3A and 3B illustrate another embodiment of a sprinkler 300. The sprinkler 300 includes a stationary base 302 coupled to a rotatable member 306 and a truncated cone member 304 affixed to the rotatable member 306. Hose connector 303 extends from the base 302. A plurality of spray arms 308 fluidly communicating with the base 302, extend from rotatable member 306. Each spray arm 308 includes at least one hole 309. A plurality of orifices 313 is located in a top surface 310 of the rotatable member 306, in fluid communication with the base 302. According to one embodiment, the plurality of orifices 313 includes multi-sized orifices. For example, in one embodiment, the orifices are three in number, each one having a different diameter. However, it is to be appreciated that top surface 310 of rotatable member 306 may include any number of orifices 313 configured in any desirable way. It also is to be appreciated that the orifices may be located anywhere on the rotatable member 306.

The sprinkler 300 operates in substantially the same way as the sprinkler 100 described in relation to FIG. 1; however, the sprinkler 300 further includes one or more water tubes 311 extending upwardly within the cone member 304. According to one embodiment, the sprinkler 300 includes three water tubes 311; however, it is to be appreciated that the sprinkler 300 may include any number of water tubes 311. In one embodiment, each water tube 311 is flexible. According to one embodiment, each water tube 311 is fluidly connected to a spray arm 308. According to one embodiment, each water tube 311 is also fluidly connected at its distal end to an ornamental object 312. According to one embodiment, the ornamental objects 312 may depict images that complement and enhance the spinning spiral or tornado cloud spray theme. For example, as shown in FIGS. 3A and 3B, the plurality of ornamental objects 312 includes a tree, a lightning bolt and a house. However, it is to be appreciated that the ornamental objects 312 may depict any type of image.

Hose connector 303 is configured to be coupled to a hose (not shown), for example an ordinary garden hose, for supplying water to the sprinkler 300 in conventional fashion. Water travels through the hose connector 303 to the rotatable member 306 and is sprayed from the holes 309, causing the rotatable member 306, and hence the cone member 304, to spin (as discussed above). Streams of water are also sprayed from the plurality of orifices 313, as discussed above.

As the rotatable member 306 spins, the streams of water sprayed out of orifices 313 create a rotating spray pattern as discussed above (not shown). According to one embodiment, the cone member 304 encompasses at least a portion of the water streams (not shown) as they are sprayed out of the orifices 313, with the water streams ultimately exiting through the top 305 of the cone member 304. According to one embodiment, the spinning cone member 304 and the rotating spray pattern combine to create a visual effect by which it appears to a user that the cone member 304 and the spraying water constitute a spinning spiral or tornado cloud extending upwardly from the base 302.

In addition to spraying out of the plurality of orifices 313, water from the rotatable member 306 also flows into the water tubes 311, causing the water tubes 301 to stand upright with the ornamental object 312 elevated. According to one embodiment, water within the water tubes 311 may also cause the water tubes 311 to undulate. In one embodiment, water passing through the tubes 301 is also sprayed out of at least one hole or orifice (not shown) in each ornamental object 312. As the rotatable member 306 spins, the water tubes 311 and attached ornamental objects 312 also rotate, creating a visual effect by which it appears that the ornamental objects 312 are being lifted and spun around by the cone member 304. According to one embodiment, as the rotatable member 306 spins, the spinning water tubes 311 and/or ornamental objects 312 may come in contact with or rest against the cone member 304. It is to be appreciated that in such an embodiment, contact between the cone member 304 and the water tubes 311 and/or ornamental objects 312 may prevent multiple water tubes 311 from becoming entangled.

Alternatively, rather than being coupled to the spray arms 308, water tubes 301 may be coupled to a stationary portion of the sprinkler 300 (e.g., the base 302), so that, as the rotatable member 306 and cone member 304 spin, the water tubes do not spin, but of course they may be buffeted by the spraying water from holes 309.

Figure 4A:
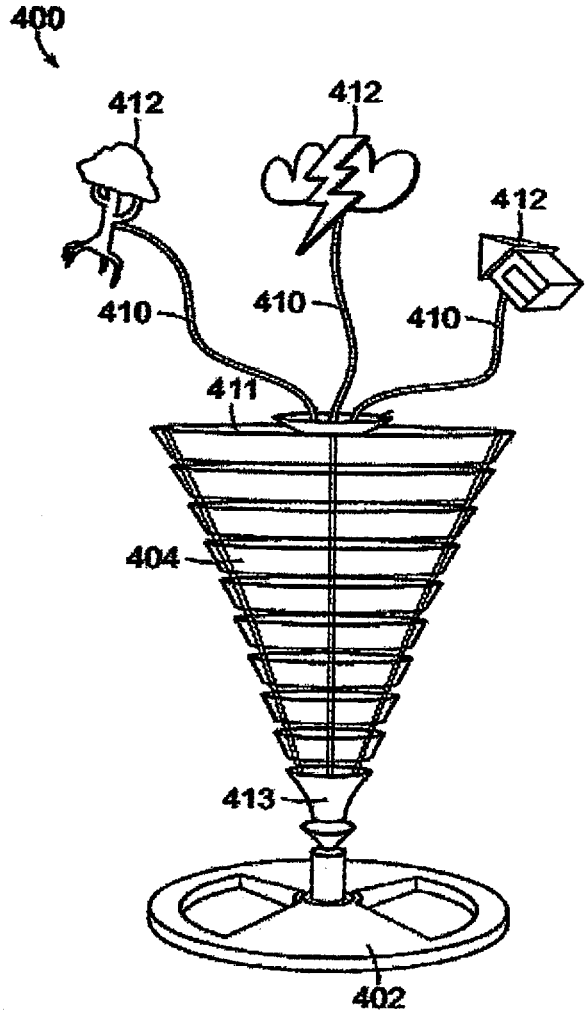
FIGS. 4A-4B illustrate another sprinkler in accordance with aspects of the present invention.
Figure 4B:
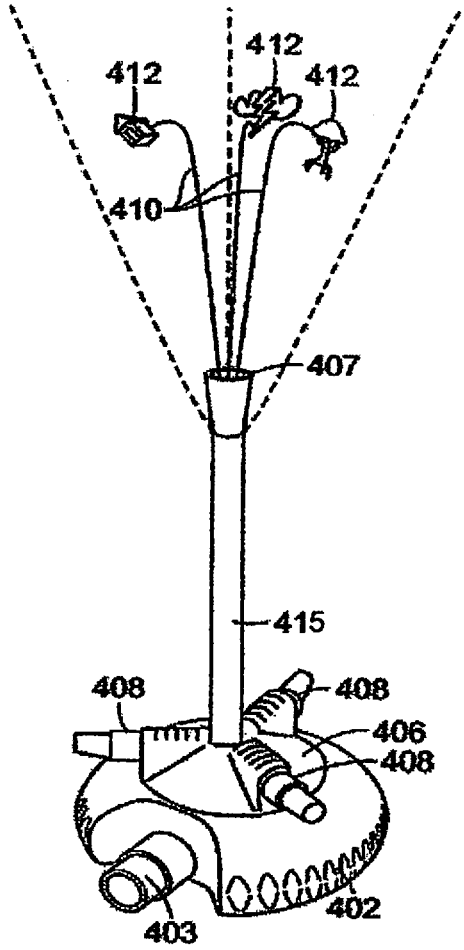

FIGS. 4A and 4B illustrate another embodiment of a sprinkler 400. The sprinkler 400 includes a stationary base 402 coupled to a rotatable member 406 through a center post member 415. The sprinkler 400 also includes a truncated cone member 404 affixed to the rotatable member 406. Hose connector 403 extends from the base 402. A plurality of spray arms 408 fluidly communicating with the base 402, extend from rotatable member 406. Each spray arm 408 includes at least one hole (not shown). A plurality of orifices 407 is located in the rotatable member 406. According to one embodiment, the plurality of orifices 407 includes multi-sized orifices. For example, in one embodiment, the orifices are three in number, each one having a different diameter. However, it is to be appreciated that the rotatable member 406 may include any number of orifices 407 configured in any desirable way. It also is to be appreciated that the orifices may be located anywhere on the rotatable member 406. The sprinkler 400 also includes a plurality of additional water tubes 410. According to one embodiment, the sprinkler 400 includes three water tubes 410; however, it is to be appreciated that the sprinkler 400 may include any number of water tubes 410. According to one embodiment, each water tube 410 is also fluidly connected to an ornamental object 412.

The sprinkler 400 is substantially the same as the sprinkler 300 described in relation to FIGS. 3A and 3B; however, the center post member 415 of the sprinkler 400 is longer than the post member 115 of the sprinkler 300. According to one embodiment, the plurality of orifices 407 is located at the top of the center post member 415. The center post member 402 elevates the plurality of orifices 407 to the top 411 of the cone member 404. Hence, water is sprayed out of the orifices 407 at the top 411 of the cone member 404, in a rotating spray pattern (as discussed above), as opposed to the bottom 413 of the cone 404 as described in relation to FIG. 1. In addition, the water tubes 410 and accompanying ornamentation 412 are also attached to the center post 415, as opposed to the spray arms 408, as described in relation to FIGS. 3A and 3B.

Figure 5:
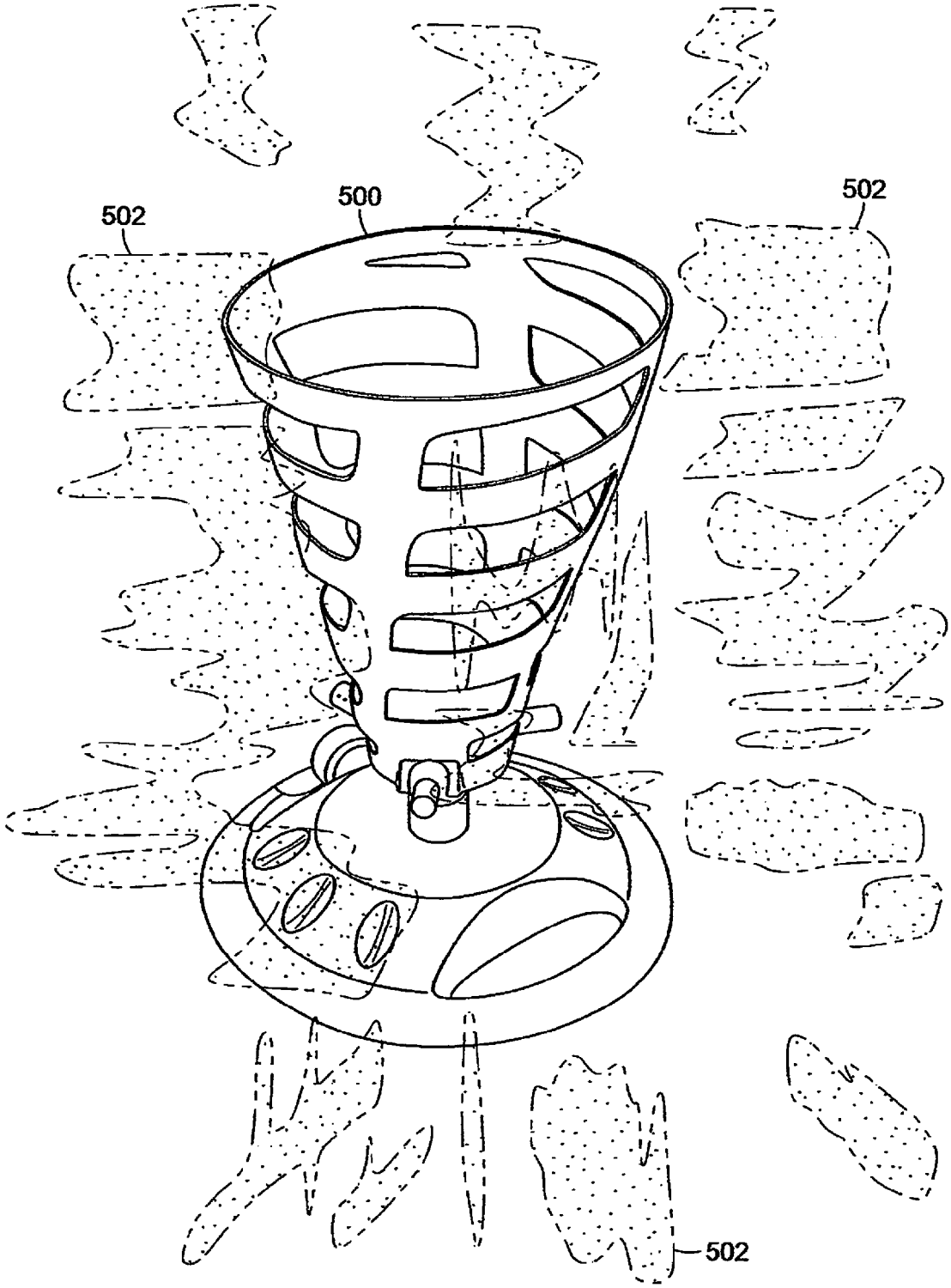
FIG. 5 is a holographic view of a sprinkler in accordance with aspects of the present invention.

According to one embodiment, the sprinkler, as described above, may be made of any suitable type of plastic, such as Polyvinyl Chloride (PVC), inflatable PVC, or molded plastic. In addition, according to one embodiment, the sprinkler may be covered in a reflective material. The reflective material may be configured to reflect light back toward a viewer's eyes. According to one embodiment, a viewer may look at the sprinkler with glasses or goggles having at least one holographic lens. Light reflected off of the reflective material of the sprinkler, and/or light reflected off water spraying from the sprinkler, may cause the holographic lenses to project a holographic image to the eyes of the user. For example, FIG. 5 illustrates a holographic view of a sprinkler 500. Light reflected from the sprinkler 500 results in rainbow holograms 502 reflecting onto the eye of the user. It is to be appreciated that any type of hologram may be reflected onto the eye of the user.

Having thus described at least one embodiment of the present disclosure, various alternations, modifications and improvements will readily occur to those skilled in the art. Such alterations, modifications and improvements are intended to be within the scope and spirit of the disclosure. Accordingly, the foregoing description is by way of example only and is not intended to be limiting. The disclosure's limit is defined only in the following claims and equivalents thereto.

What is claimed is:

1. A sprinkler comprising:

a base;

a connector coupled to the base and configured for coupling to an external water supply; and a body rotatably mounted on the base and in fluid communication with the water supply through the connector and the base, the body including one or more orifices configured to spray, in a defined pattern, water received from the external water supply, and further including at least one hole configured to spray, in a substantially horizontal direction, water received from the external water supply, wherein the spray exiting from the at least one hole causes said body to rotate, and wherein the defined pattern of the spray exiting the one or more orifices is a spiral or helical-shaped spray; further comprising a cone-shaped member extending upwardly from the body and adapted to encompass at least a portion of the defined pattern.

2. The sprinkler of claim 1, further comprising at least one water tube fluidly coupled via the body and the connector to the water supply, wherein the at least one water tube is configured to stand upright when filled with water from the water supply.

3. The sprinkler of claim 2, wherein the at least one water tube includes an ornamental object coupled to an end thereof.

4. The sprinkler of claim 3, wherein the at least one water tube is further configured to elevate the ornamental object when water fills the at least one water tube.

5. The sprinkler of claim 1, wherein the cone-shaped member includes one or more openings between ends of the cone-shaped member to allow water sprayed from the orifices to exit the cone-shaped member.

6. The sprinkler of claim 1, wherein said body includes a plurality of orifices, each orifice having a different diameter.

7. The sprinkler of claim 5, wherein an outer surface of the cone-shaped member is covered in a reflective material.

8. The sprinkler of claim 1, wherein the direction at which the spray exits from the at least one hole is adjustable.

9. The sprinkler of claim 1, wherein the body further includes a post member extending upwardly from the body, the post member having a bottom portion coupled to the body and a top portion including the one or more orifices.

10. A method for providing a helical-shaped spray from a sprinkler, the method comprising:

providing a base;

providing a hose connector coupled to the base and configured for fluid connection to an external water supply;

providing a body rotatably mounted on the base and in fluid communication with the external water supply via the hose connector and the base, the body including one or more orifices configured to spray, in a defined pattern, water received from the external water supply, and further including at least one hole configured to spray, in a substantially horizontal direction, water received from the external water supply; coupling the hose connector to the external water supply;

providing a flow of water to the body from the external water supply via the hose connector so that the spray exiting from the at least one hole causes said body to rotate, and so that the defined pattern exiting the one or more orifices is a spiral or helical-shaped spray; and further comprising: providing a cone-shaped member extending upwardly from the body; and encompassing at least a portion of the defined pattern with the cone-shaped member.

11. The method of claim 10, further comprising:

providing at least one water tube attached to the body and fluidly coupled to the external water supply via the body and the hose connector; and causing the at least one water tube to stand upright by filling the at least one water tube with water from the water supply.

12. The method of claim 11, further comprising providing an ornamental object coupled to an end of the at least one water tube.

13. The method of claim 12, further comprising elevating the ornamental object by filling the at least one water tube with water from the water supply.

14. The method of claim 10, further comprising adjusting the rotational speed of the body.

15. The method of claim 14, wherein said adjusting includes adjusting the direction at which the spray exits from the at least one hole.

* * * * *